US006065947A

United States Patent [19]

Wu

[11] Patent Number: 6,065,947

[45] Date of Patent: May 23, 2000

[54] TWO-STROKE OPERABLE PUMP

[76] Inventor: Scott Wu, P.O. Box 63-247, Taichung, Taiwan

[21] Appl. No.: 09/211,120

[22] Filed: Dec. 14, 1998

[51] Int. Cl.[7] ..... F04B 5/02; F04B 53/12

[52] U.S. Cl. ..... 417/526; 417/527; 417/546; 417/547; 417/553; 417/566

[58] Field of Search ..... 417/525, 526, 417/527, 546, 547, 550, 553, 566

[56] References Cited

U.S. PATENT DOCUMENTS 5,127,804 7/1992 Chappell ..... 417/546 X
5,443,370 8/1995 Wang ..... 417/526 X
5,449,278 9/1995 Lin ..... 417/526
5,531,575 7/1996 Lin ..... 417/526
5,681,154 10/1997 Yang ..... 417/526 X
5,683,234 11/1997 Chuang et al. ..... 417/526 X

*Primary Examiner*—Tony M. Argenbright
*Attorney, Agent, or Firm*—Alan Kamrath; Oppenheimer Wolff & Donnelly LLP

[57] ABSTRACT

A pump includes a main body, a piston slidably received in the main body, and a hose having a first end attached to an end of the main body and a second end attached to the piston. A handle is attached to a piston rod, which, in turn, is attached to the piston. Air is outputted to a main passage via the hose during an outward stroke. Air is outputted to the main passage via a hole defined in the end of the main body during an inward stroke.

7 Claims, 13 Drawing Sheets

TWO-STROKE OPERABLE PUMP

BACKGROUND OF THE INVENTION

1. Field of the Invention

The present invention relates to a two-stroke operable hand air pump that may pump air during every stroke of the piston.

2. Description of the Related Art

A conventional air pump may output air in an output stroke only such that the user is exhausted very soon. A two-stroke operable pump has been proposed to output air during every stroke of the piston. Two sealing rings each having an annularly extending conic lip are respectively mounted in two annular grooves of the piston such that the conic lips face each other. The lips are in sealing contact with an inner periphery of a cylinder. In addition, each lip is deformable toward the piston rod to allow passage of air, thereby allowing output of air during each stroke of the piston. It is, however, found that, air tends to leak in the lip portion, as the lip that is compressed by high pressure air is hollow.

The present invention is intended to provide improved two-stroke operable pumps to solve this problem.

SUMMARY OF THE INVENTION

It is a primary object of the present invention to provide an improved two-stroke operable pump for outputting air during each stroke of the piston.

In accordance with one aspect of the invention, a pump comprises:

a main body defining a chamber therein and including a first end and a second end, a head mounted to the first end of the main body and including a main passage that is adapted to be communicated with a valve, the head further including a side passage, an inner tube securely mounted in the main body and including a first end communicated with the main passage of the head and a second end, a hollow piston slidably received in the main body, the hollow piston separating the chamber of the main body into a first chamber and a second chamber, the first chamber being communicated with atmosphere via the side passage of the head, the hollow piston head further including a first annular groove defined in an outer periphery thereof and adjacent to the first end of the main body, the hollow piston head further including a second annular groove defined in an outer periphery and adjacent to the second end of the main body, the first annular groove including a first notch extended along a longitudinal direction of the hollow piston, the second annular groove including a second notch extended along the longitudinal direction of the hollow piston, a first O-ring being mounted in the first annular groove, a second O-ring being mounted in the second annular groove, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a transverse hole defined therein to communicate an interior of the second section with a space between the first O-ring, the second O-ring, and an inner periphery of the main body, a first valve means mounted in first end of the main body such that air is only flowable from atmosphere to the first chamber of the main body via the side passage, a hollow piston rod having a first end attached to the piston and a second end extended outside the main body, the hollow piston rod including an interior for partially receiving the inner tube and communicated with the interior of the second section of the piston, an end cap mounted to seal the second end of the main body and including a passage that communicates the second chamber of the main body with atmosphere, a second valve means mounted to in second end of the main body such that air is only flowable from atmosphere to the second chamber of the main body via the passage of the end cap, a handle attached to the second end of the piston rod for operation, wherein when during an outward stroke of the piston in which the handle moves away from the main body, the second O-ring is moved to abut an end edge of the second notch to allow communication between the space and the second chamber while the first chamber is not communicated with the space, such that air in the second chamber is outputted to the main passage via the space, the interior of the hollow piston rod, and the inner tube, while ambient air enters the first chamber via the side passage of the head, and wherein when during an inward stroke of the piston in which the handle moves toward the main body, the first O-ring is moved to abut an end edge of the first notch to allow communication between the space and the first chamber while the second chamber is not communicated with the space, such that air in the first chamber is outputted to the main passage via the space, the interior of the hollow piston rod, and the inner tube, while ambient air enters the second chamber via the passage of the end cap.

In accordance with another aspect of the invention, a pump comprises:

a main body defining a chamber therein and including a first end and a second end, a head mounted to the first end of the main body and including a main passage that is adapted to be communicated with a valve, the head further including a side passage and a first passage, an inner tube securely mounted in the main body and including a first end communicated with the main passage of the head and a second end, a hollow piston slidably received in the main body, the hollow piston separating the chamber of the main body into a first chamber and a second chamber, the first chamber being communicated with atmosphere via the side passage of the head, the first chamber being communicated with the main passage of the head via first passage of the head, the hollow piston head further including a first annular groove defined in an outer periphery thereof and adjacent to the first end of the main body, the hollow piston head further including a second annular groove defined in an outer periphery and adjacent to the second end of the main body, the second annular groove including a notch extended along a longitudinal direction of the hollow piston, a first O-ring being mounted in the first annular groove, a second O-ring being mounted in the second annular groove, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a transverse hole defined therein to communicate an interior of the second section with a space between the first O-ring, the second O-ring, and an inner periphery of the main body, a first valve means mounted to the first end of the main body such that air is only flowable from atmosphere to the first chamber of the main body via the side passage, a hollow piston rod having a first end attached to the piston and a second end extended outside the main body, the hollow piston rod including an interior for partially receiving the inner tube and communicated with the interior of the second section of the piston, an end cap mounted to seal the second end of the main body and including a second passage that communicates the second chamber of the main body with atmosphere, a second valve means mounted to the second end of the main body such that air is only flowable from atmosphere to the second chamber of the main body.

a handle attached to the second end of the piston rod for operation, wherein when during an outward stroke of the piston in which the handle moves away from the main body, the second O-ring is moved to abut an end edge of the notch to allow communication between the space and the second chamber while the first chamber is not communicated with the space, such that air in the second chamber is outputted to the main passage via the space, the interior of the hollow piston rod, and the inner tube, while ambient air enters the first chamber via the side passage of the head, and wherein when during an inward stroke of the piston in which the handle moves toward the main body, the second O-ring is moved to disengage from of the notch such that both of the first chamber and the second chamber are not communicated with the space and that air in the first chamber is outputted to the main passage via the first passage of the head, while ambient air enters the second chamber via the second passage of the end cap.

In accordance with a further aspect of the invention, a pump comprises:

a main body defining a chamber therein and including a first end and a second end, the first end including a first hole and a second hole, the main body further including a third hole defined in an outer periphery thereof and adjacent to the first end of the main body, a head mounted to the first end of the main body and including a main passage that is adapted to be communicated with a valve, a piston slidably received in the main body, the piston separating the chamber of the main body into a first chamber and a second chamber, the first chamber being communicated with atmosphere via the third hole of the main body, the main passage of the head being communicated with the upper chamber via the second hole, a hose mounted in the main body and including a first end connected to the first end of the main body and a second end connected to the piston, a first check valve mounted in the first hole of the head such that air is only flowable from the hose to the main passage, a second check valve mounted in the second hole of the head such that air is only flowable from the first chamber to the main passage, a third check valve mounted in the third hole of the main body such that air is only flowable from atmosphere to the first chamber, a piston rod having a first end attached to the piston and a second end extended outside the main body, an end cap mounted to seal the second end of the main body and including a fourth hole that communicates the second chamber of the main body with atmosphere, a fourth check valve mounted in the fourth hole of the end cap such that air is only flowable from atmosphere to the second chamber, the piston further including a fifth hole defined therein for communicating the second chamber with the second end of the hose, a fifth check valve mounted in the fifth hole of the piston such that air is only flowable from the second chamber to the hose, a handle attached to the second end of the piston rod for operation, wherein when during an outward stroke of the piston in which the handle moves away from the main body, air in the second chamber is outputted to the main passage via the fifth hole, the hose, and the first hole, while ambient air enters the first chamber via the third hole, and wherein when during an inward stroke of the piston in which the handle moves toward the main body, air in the first chamber is outputted to the main passage via the second hole, while ambient air enters the second chamber via the fourth hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
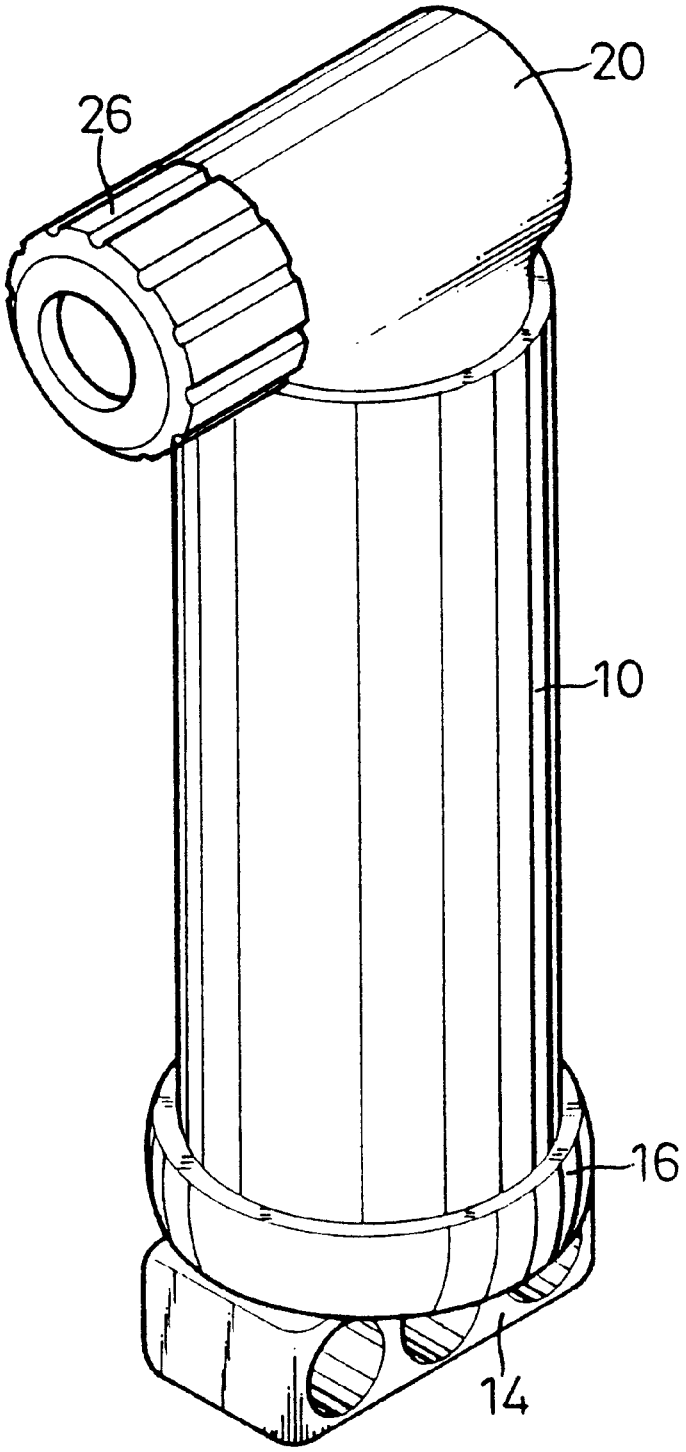
FIG. 1 is a perspective view of a first embodiment of a two-stroke operable pump in accordance with the present invention.
Figure 2:
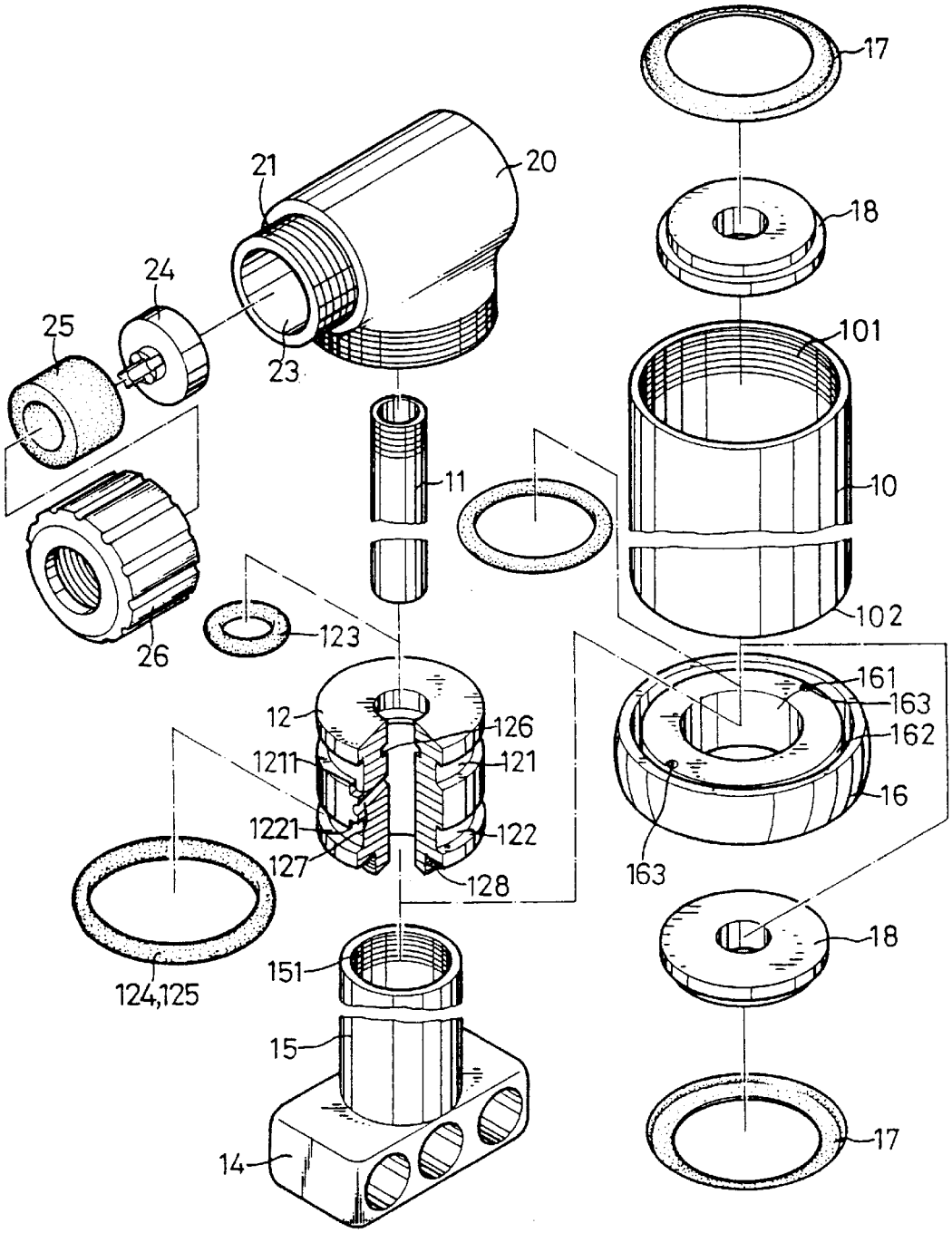
FIG. 2 is an exploded view of the first embodiment of the two-stroke operable pump in accordance with the present invention.
Figure 4:
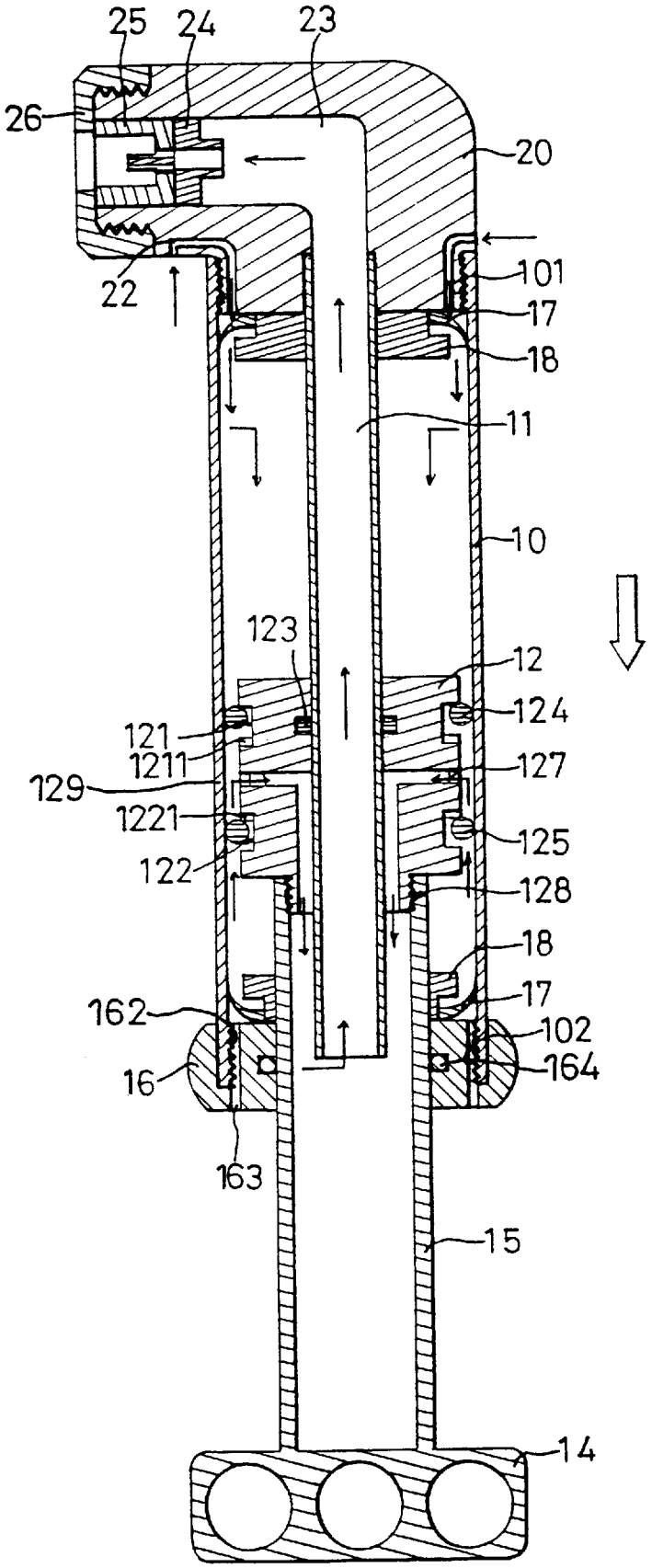
FIG. 4 is a sectional view of the first embodiment of the two-stroke operable pump in accordance with the present invention, illustrating an outward stroke of the piston.

Referring to the drawings and initially to FIGS. 1 and 2, a first embodiment of a two-stroke operable pump in accordance with the present invention generally includes a cylindrical main body 10 defining a chamber (not labeled) therein, a head 20 having a first end threadedly engaged with an inner threading 101 of a first end of the main body 10 and a second end 21, an end cap 26 threadedly engaged with an outer threading (not labeled) of the second end 21 of the head 20, and a piston 12 slidably received in the main body 20. The piston 12 separates the chamber of the main body 10 into an upper chamber (not labeled) and a lower chamber (not labeled). The head 20 includes a main passage 23 communicated with the upper chamber (not labeled), and a nozzle 24 and a sleeve 25 are mounted in the second end 21 of the head 20. Referring to FIG. 4, the head 20 further includes an annular side passage 22 that communicates the upper chamber of the main body 10 with atmosphere.

Figure 3:
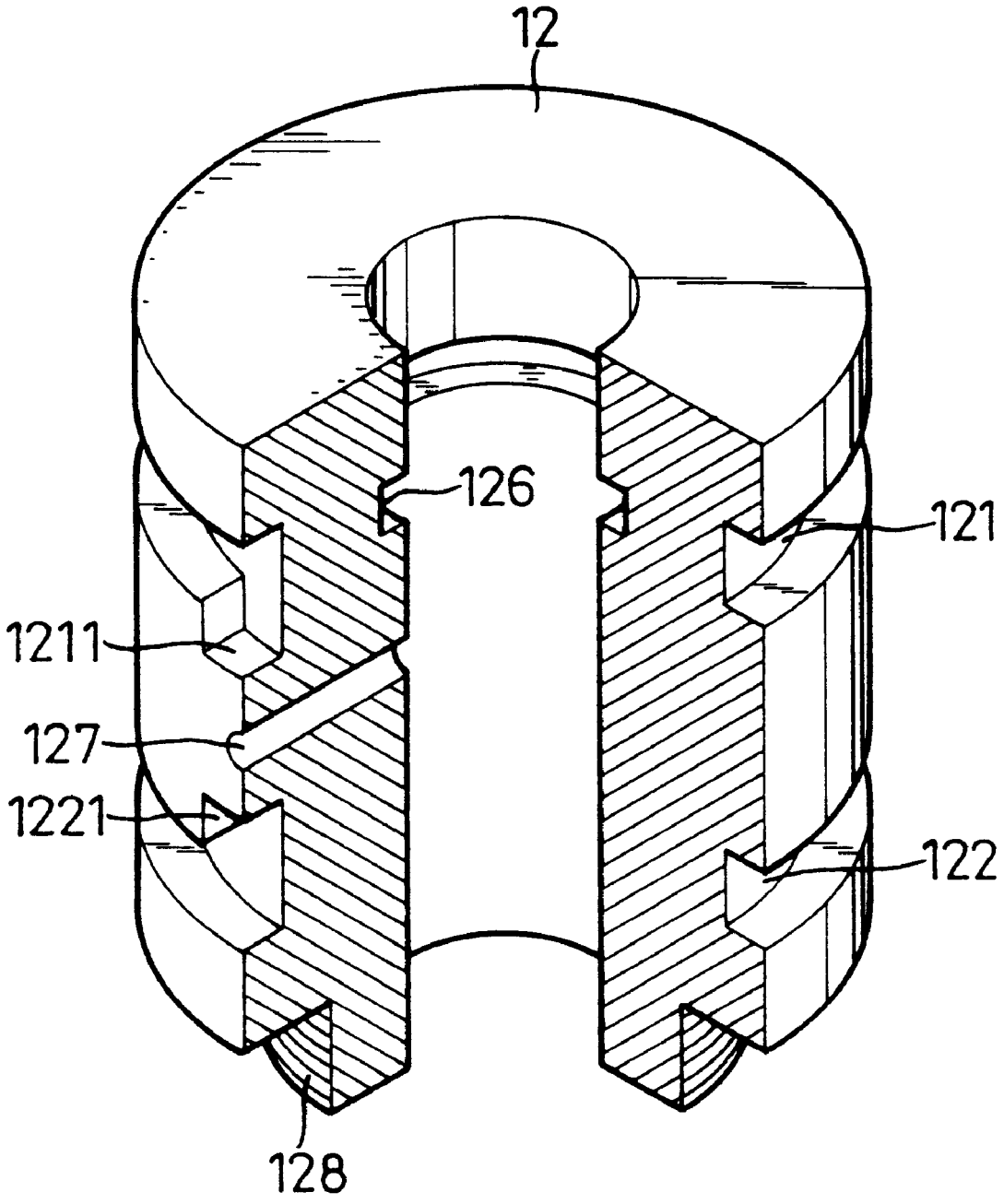
FIG. 3 is a perspective view, partly cutaway, of a piston of the first embodiment of the two-stroke operable pump in accordance with the present invention.

An inner tube 11 is securely mounted in the main body 10 and supported by an upper support 18, which, in turn, is secured to the first end of the main body 10, best shown in FIG. 4. Referring to FIGS. 3 and 4, the piston 12 is hollow so as to slide along the inner tube 11. An outer periphery of the piston 12 includes two annular grooves 121, 122 each for receiving an O-ring 124, 125 therein. Each annular groove 121, 122 further includes a notch 1211, 1221 extended along a longitudinal direction of the piston 12. An inner periphery of the piston 12 includes a reduced first section for sliding contact with an outer periphery of the inner tube 11 and a second section that has an inner diameter greater than that of the reduced first end. The reduced first section includes an annular groove 126 defined therein for receiving an O-ring 123 therein. The piston 12 further includes a transverse hole 127 extending between the two annular grooves 121 and 122 along a radial direction to communicate an interior of the second section with a space 129 between the annular grooves 121, 122 and the inner periphery of the main body 10. A first end of a piston rod 15 is threadedly engaged with an outer threading 128 of the piston 12 to move therewith, and a handle 14 is attached to a second end of the piston rod 15 extended outside the main body 10 for manual operation. An end cap 16 is engaged to the second end of the main body 10 by threading 162 of the end cap 16 and threading 102 of the main body 10. The end cap 16 includes an annular passage 163 that communicates the lower chamber of the main body 10 with atmosphere. An annular flexible diaphragm 17 is mounted to an interior of the second end of the main body 10 adjacent to the annular passage 163 and arranged in a manner that air is flowable from atmosphere into the chamber, and the reverse flow is prohibited. An O-ring 164 is provided between the end cap 16 and the piston rod 15 to achieve the sealing effect. In addition, a further annular diaphragm 17 is mounted to an interior of the first end of the main body 10 adjacent to the annular side passage 22 and arranged in a manner that air is flowable from atmosphere into the upper chamber of the main body 10, and the reverse flow is prohibited. A lower support 18 is mounted around the piston rod 15 and above the end cap 16 for retaining the lower annular diaphragm 17 in place.

Figure 5:
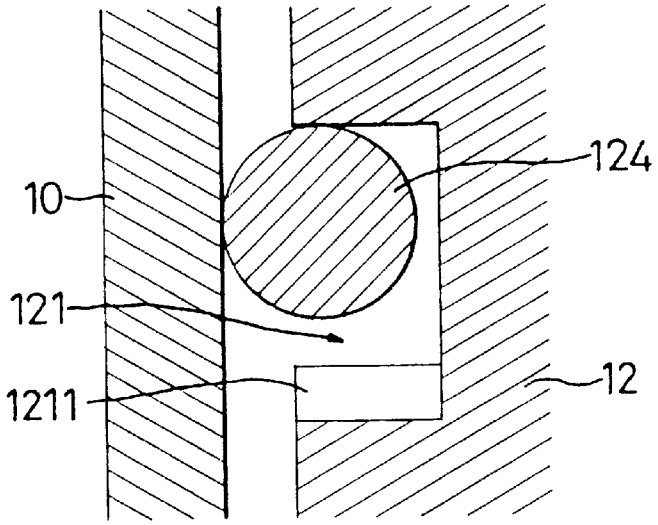
FIG. 5 is an enlarged view illustrating the status of an O-ring during the outward stroke of the piston.

FIG. 4 illustrates an outward stroke of the piston in which the handle 14 is moved away from the main body 10. As shown in FIG. 5, during the outward stroke, the O-ring 124 bears against an upper edge (as viewed from the direction of FIG. 5) of the groove 121 under action of the air in the chamber under pressure such that air is not flowable from the upper chamber of the main body 10 into the space 129. Yet, the other O-ring 125 (FIG. 4) is moved to abut against an edge of the notch 1221 of the annular groove 122 such that air is flowable from the lower chamber of the main body 10 into the space 129. Thus, as shown in FIG. 4, air in lower chamber enters an interior of the inner tube 11 via the space 129, the transverse hole 127, and interior of the piston rod 15. And the air fed into the inner tube 11 is outputted via the main passage 23 and the nozzle 24 to a valve or the like. In addition, ambient air enters the upper chamber via the annular side passage 22 to compensate air and to allow smooth sliding motion of the piston 12 in the main body 10. It is appreciated that the annular diaphragms 17 act as check valves to prevent reverse flow of air.

Figure 7:
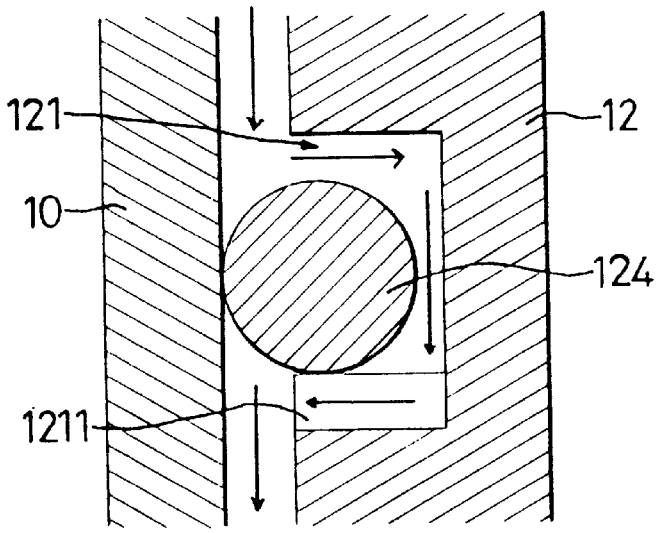
FIG. 7 is an enlarged view illustrating the status of the O-ring during the inward stroke of the piston.
Figure 6:
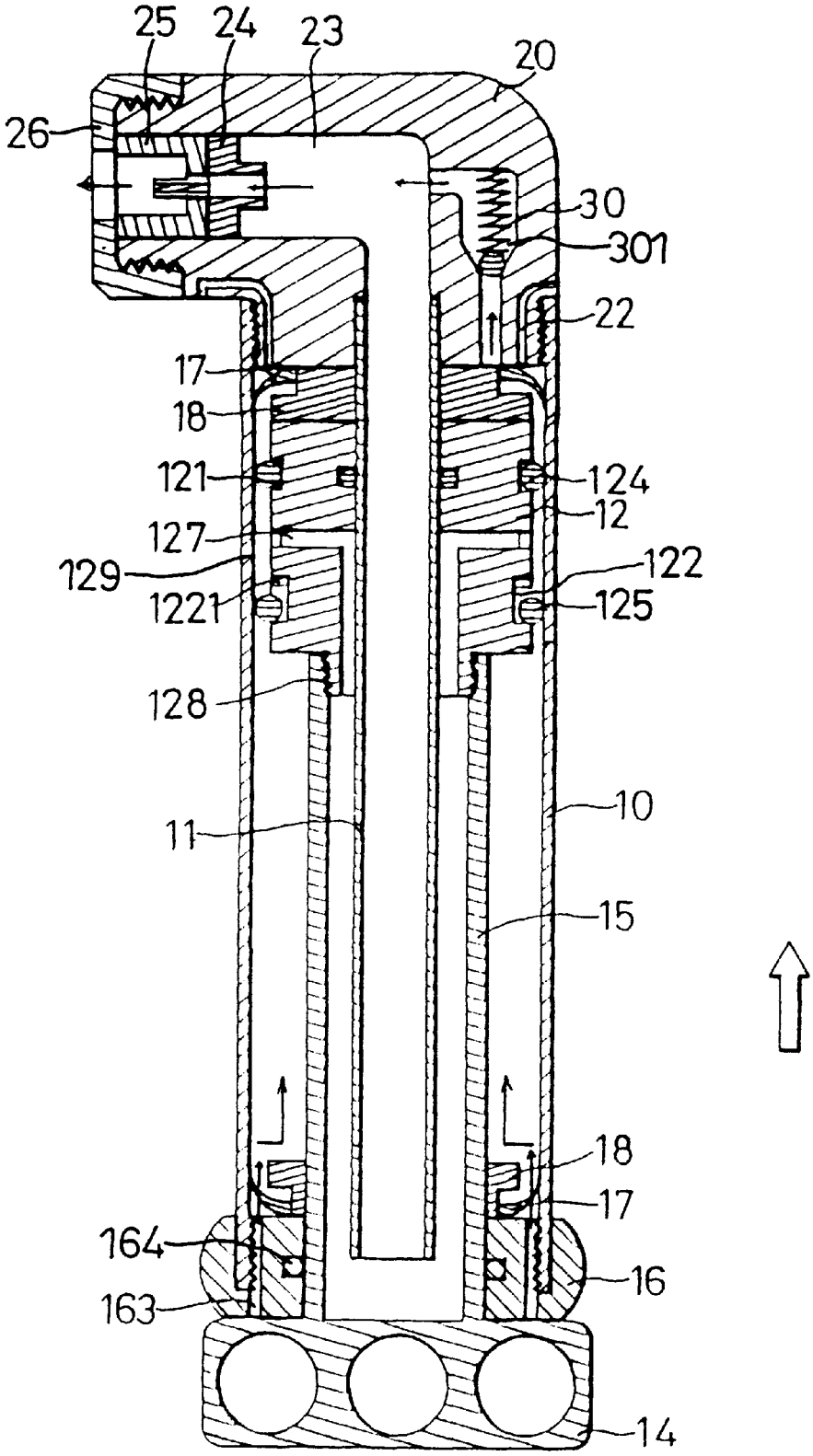
FIG. 6 is a sectional view of the first embodiment of the two-stroke operable pump in accordance with the present invention, illustrating an inward stroke of the piston.

FIG. 6 illustrates an inward stroke of the piston in which the handle 14 is moved toward the main body 10. As shown in FIG. 7, during the outward stroke, the other O-ring 124 is moved to abut against an edge of the notch 1211 of the annular groove 121 such that air is flowable from the upper chamber of the main body 10 into the space 129. Yet, the O-ring 125 bears against an upper edge of the annular groove 122 under action of the air in the chamber under pressure such that air is not flowable from the lower chamber into the space 129. Thus, as shown in FIG. 6, air in the upper chamber enters the interior of the inner tube 11 via the space 129, the transverse hole 127, and interior of the piston rod 15. And the air fed into the inner tube 11 is outputted via the main passage 23 and the nozzle 24 to a valve or the like. In addition, ambient air enters the lower chamber via the annular passage 163 to compensate air and to allow smooth sliding motion of the piston 12 in the main body 10. It is appreciated that the annular diaphragms 17 act as check valves to prevent reverse flow of air.

Thus, air is outputted in both strokes. This allows an efficient pumping effect with less labor.

Figure 8:
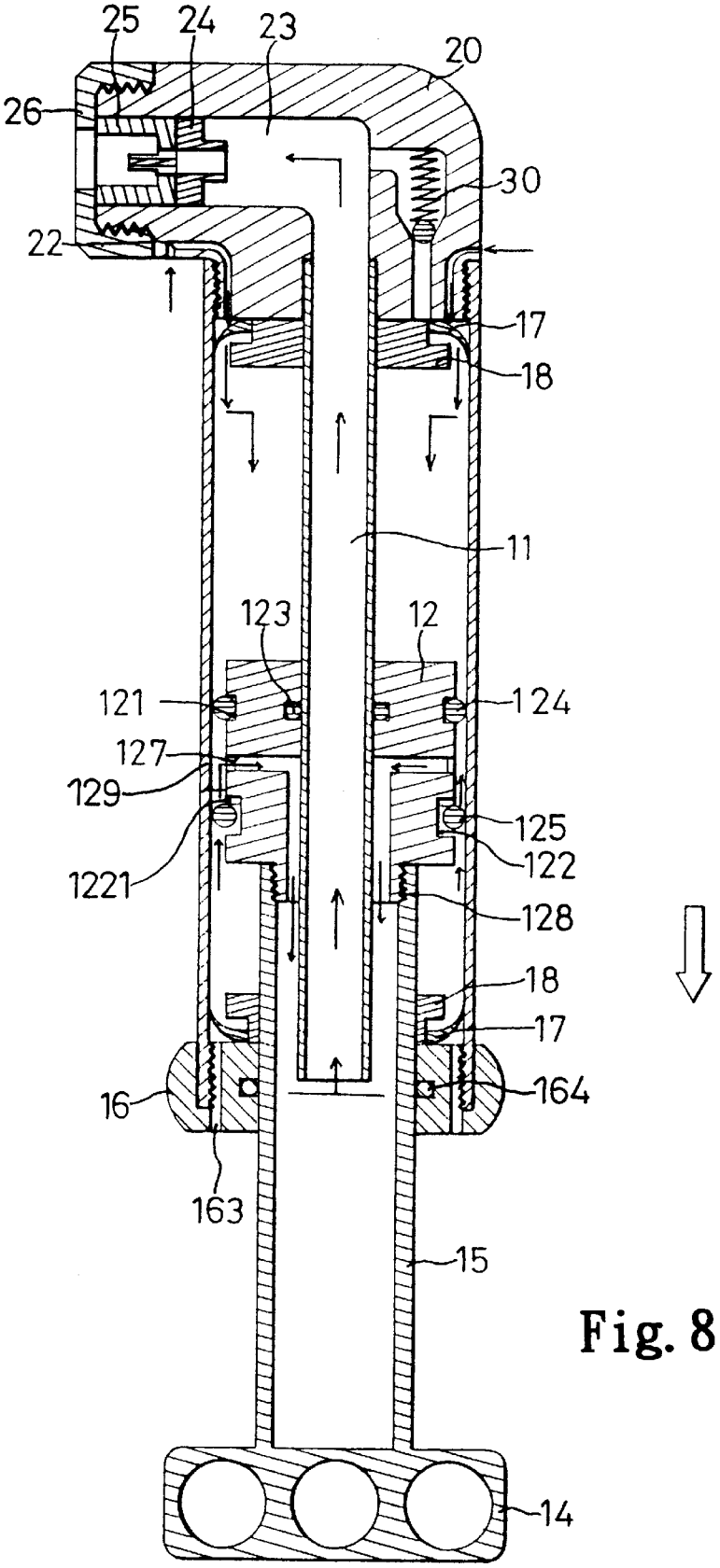
FIGS. 8 and 9 are sectional views respectively illustrating the outward stroke and the inward stroke of a modified embodiment of the two-stroke operable pump in accordance with the present invention.
Figure 9:
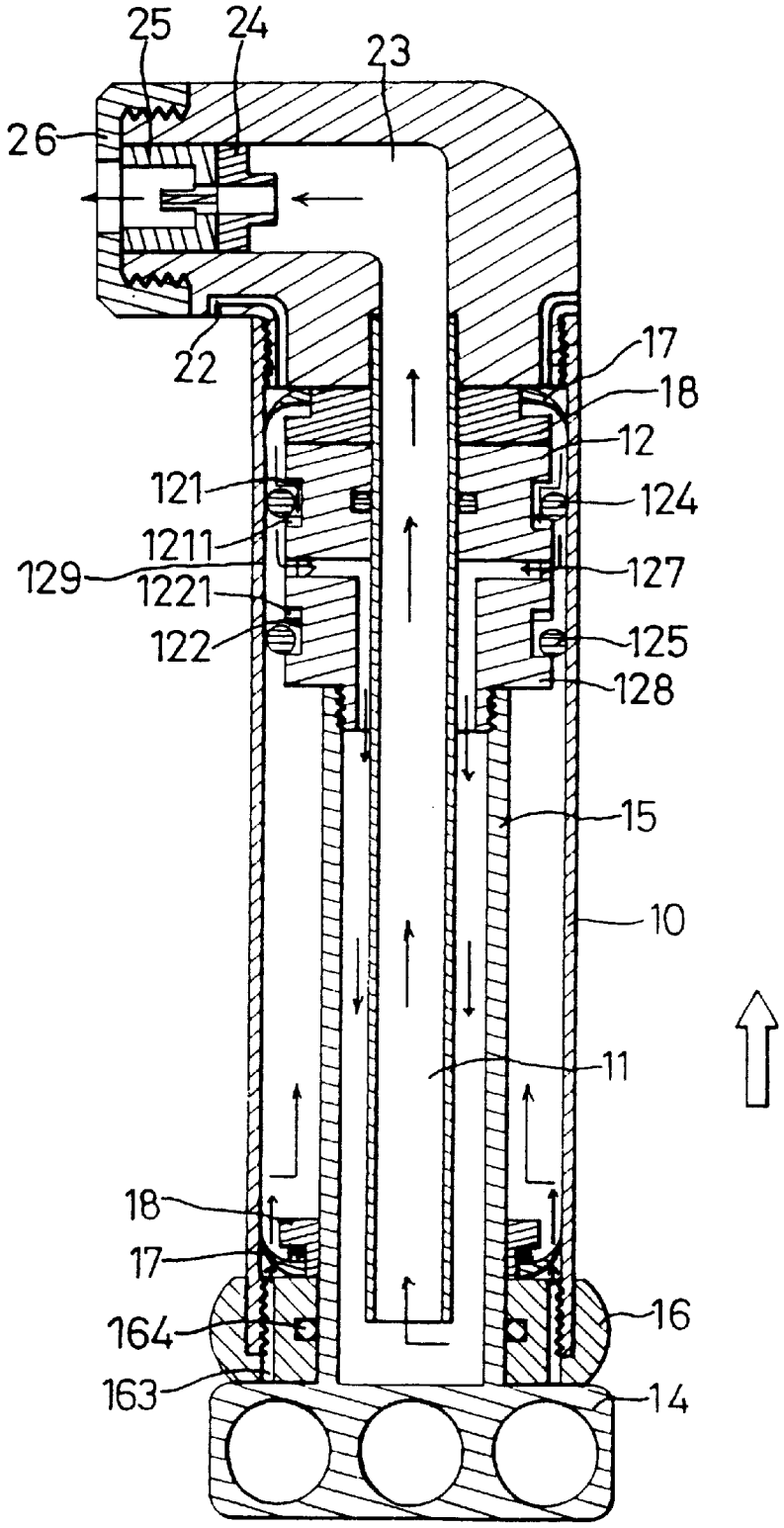

FIGS. 8 and 9 illustrate a modified embodiment of the invention, in which a check valve 30 is provided in a passage 301 that is defined in the head 20 and that communicates the main passage 30 with the upper chamber. In addition, the notch 1211 of the annular groove 121 is omitted. Referring to FIG. 8, during the outward stroke of the piston 12, air in the lower chamber enters an interior of the inner tube 11 via the space 129, the transverse hole 127, and interior of the piston rod 15. And the air fed into the inner tube 11 is outputted via the main passage 23 and the nozzle 24 to a valve or the like. In addition, ambient air enters the upper chamber via the annular side passage 22 to compensate air and to allow smooth sliding motion of the piston 12 in the main body 10. Again, the annular diaphragms 17 act as check valves to prevent reverse flow of air.

Referring to FIG. 9 during the inward stroke of the piston 12, air in the upper chamber is outputted via the passage 301, the main passage 23, and the nozzle 24 to a valve or the like. In addition, ambient air enters the lower chamber via the annular passage 163 to compensate air and to allow smooth sliding motion of the piston 12 in the main body 10. Again, the annular diaphragms 17 act as check valves to prevent reverse flow of air.

Figure 10:
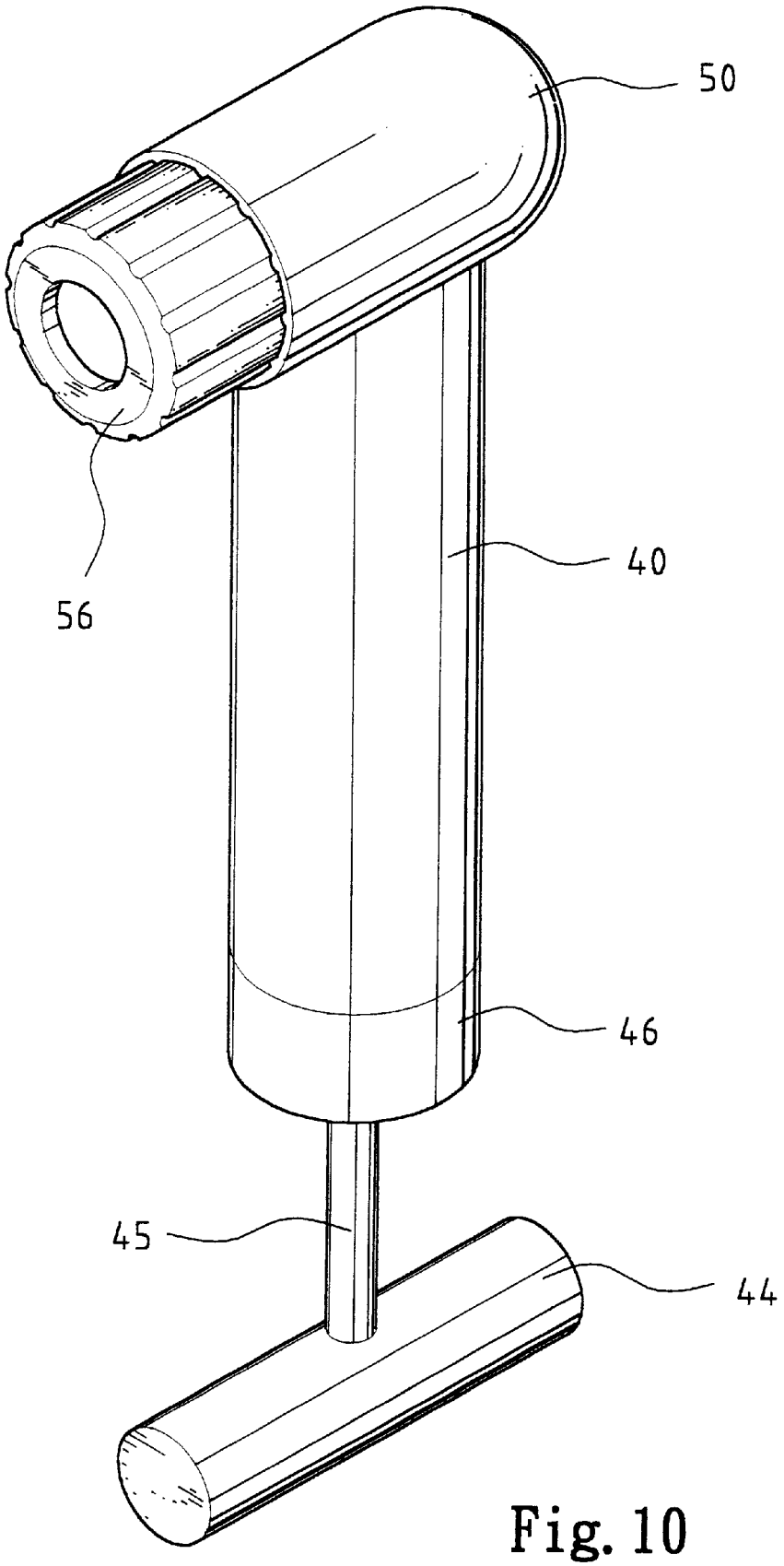
FIG. 10 is a perspective view of a second embodiment of the two-stroke operable pump in accordance with the present invention.
Figure 11:
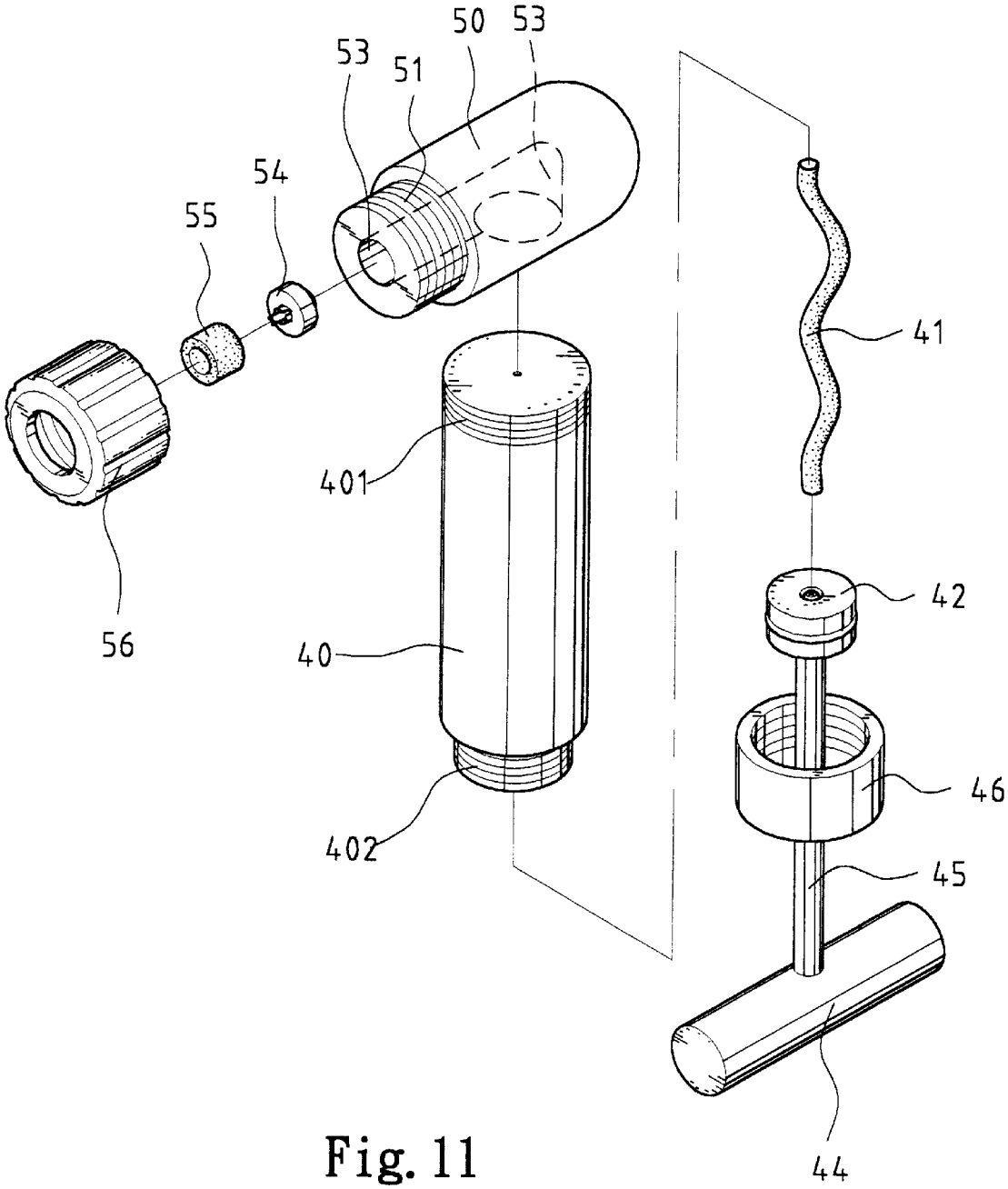
FIG. 11 is an exploded view of the second embodiment of the two-stroke operable pump in accordance with the present invention.
Figure 13:
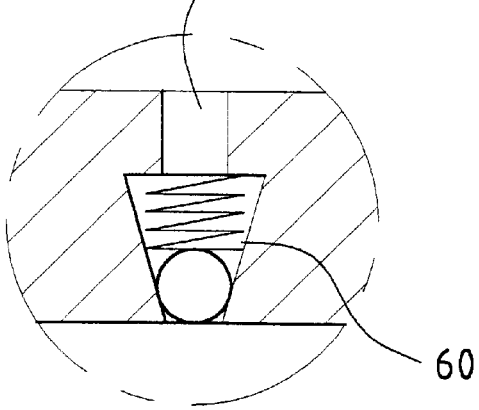
FIG. 13 is an enlarged sectional view illustrating a check valve of the pump.
Figure 12:
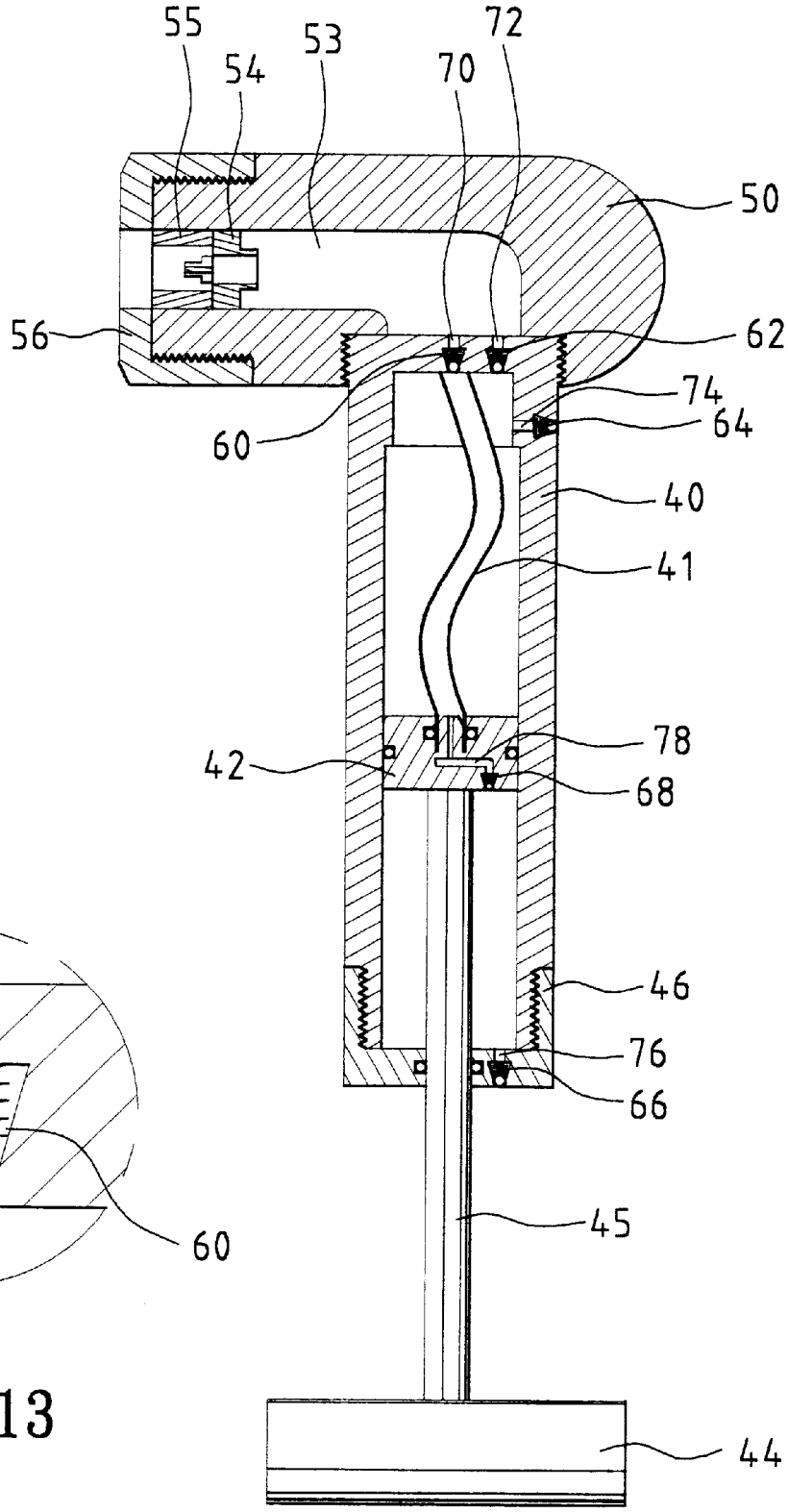
FIG. 12 is a sectional view of the second embodiment of the two-stroke operable pump in accordance with the present invention.

Referring to FIGS. 10 to 12, a second embodiment of a two-stroke operable pump in accordance with the present invention generally includes a cylindrical main body 40 defining a chamber (not labeled) therein, a head 50 having a first end threadedly engaged with an outer threading 401 of a first end of the main body 40 and a second end 51, an end cap 56 threadedly engaged with an outer threading (not labeled) of the second end 51 of the head 50, and a piston 42 slidably received in the main body 40. The piston 42 separates the chamber of the main body 40 into an upper chamber (not labeled) and a lower chamber (not labeled). The head 50 includes a main passage 53 communicated with the upper chamber (not labeled) of the main body 40, and a nozzle 54 and a sleeve 55 are mounted in the second end 51 of the head 50. The first end of the main body 40 includes a first hole 70 and a second hole 72 both communicate the main passage 53 with the upper chamber of the main body 40. Check valves 60 and 62 are mounted in the holes 70 and 72, respectively, such that air is only flowable from the chamber to the main body 10. FIG. 13 illustrates a typical arrangement of the check valve 60, which is conventional and therefore not further described. A third hole 74 is defined in a peripheral wall of the main body 40 adjacent to the first end of the main body 40, thereby communicating the upper chamber with atmosphere. A check valve 64 is mounted in the third hole 74 such that air is only flowable from atmosphere into the upper chamber.

Referring to FIG. 12, a first end of a hose 41 is securely attached to the first end of the main body 41 and arranged to communicate with the first hole 70. A second end of the hose 41 is securely attached to the piston 42, and a first end of a piston rod 45 is attached to a second end of the piston 42. A handle 45 is attached to a second end of the piston rod 15 extended outside the main body 40 for manual operation. An end cap 46 is engaged to the second end of the main body 40 by threading engagement with an outer threading 402 on the second end of the main body 40. The end cap 46 includes a fourth hole 76 that communicates the lower chamber of the main body 40 with atmosphere. A check valve 66 is mounted in the fourth hole 76 such that air is only flowable from atmosphere into the lower chamber. In addition, a fifth hole 78 is defined in the piston 42 to communicate the lower chamber with the second end of the hose 41, and a check valve 68 is mounted in the fifth hole 78 such that air is only flowable from the lower chamber into the hose 41.

Figure 14:
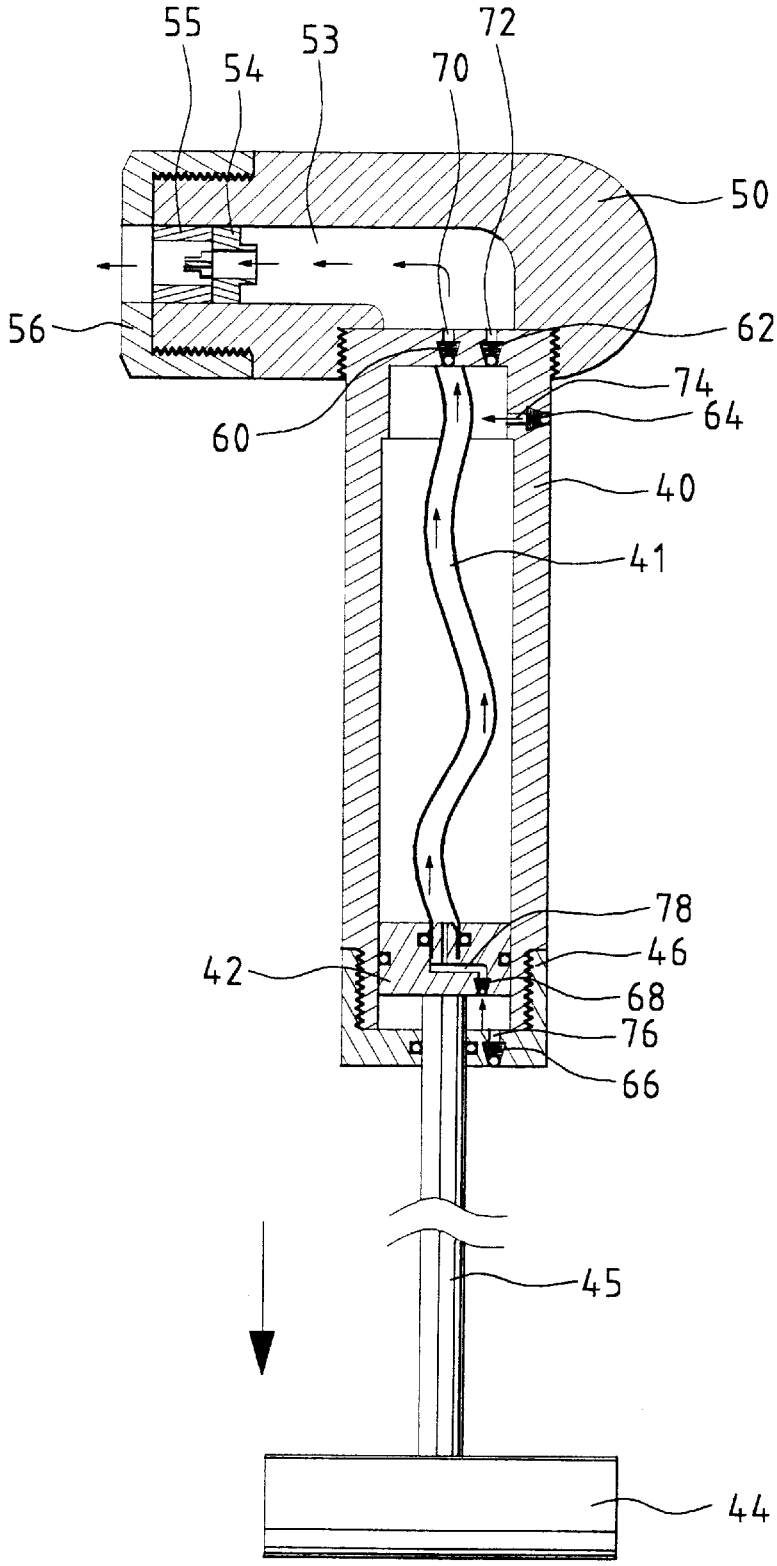
FIG. 14 is a sectional view of the second embodiment of the two-stroke operable pump in accordance with the present invention, illustrating an outward stroke of the piston.

FIG. 14 illustrates an outward stroke of the piston 42 in which the handle 44 is moved away from the main body 40. Air in lower chamber enters an interior of the hose 41 via the fifth hole 78. And the air fed into the hose 41 is outputted via the first hole 70, the main passage 53, and the nozzle 54 to a valve or the like. In addition, ambient air enters the upper chamber via the third hole 64 to compensate air and to allow smooth sliding motion of the piston 42 in the main body 40.

Figure 15:
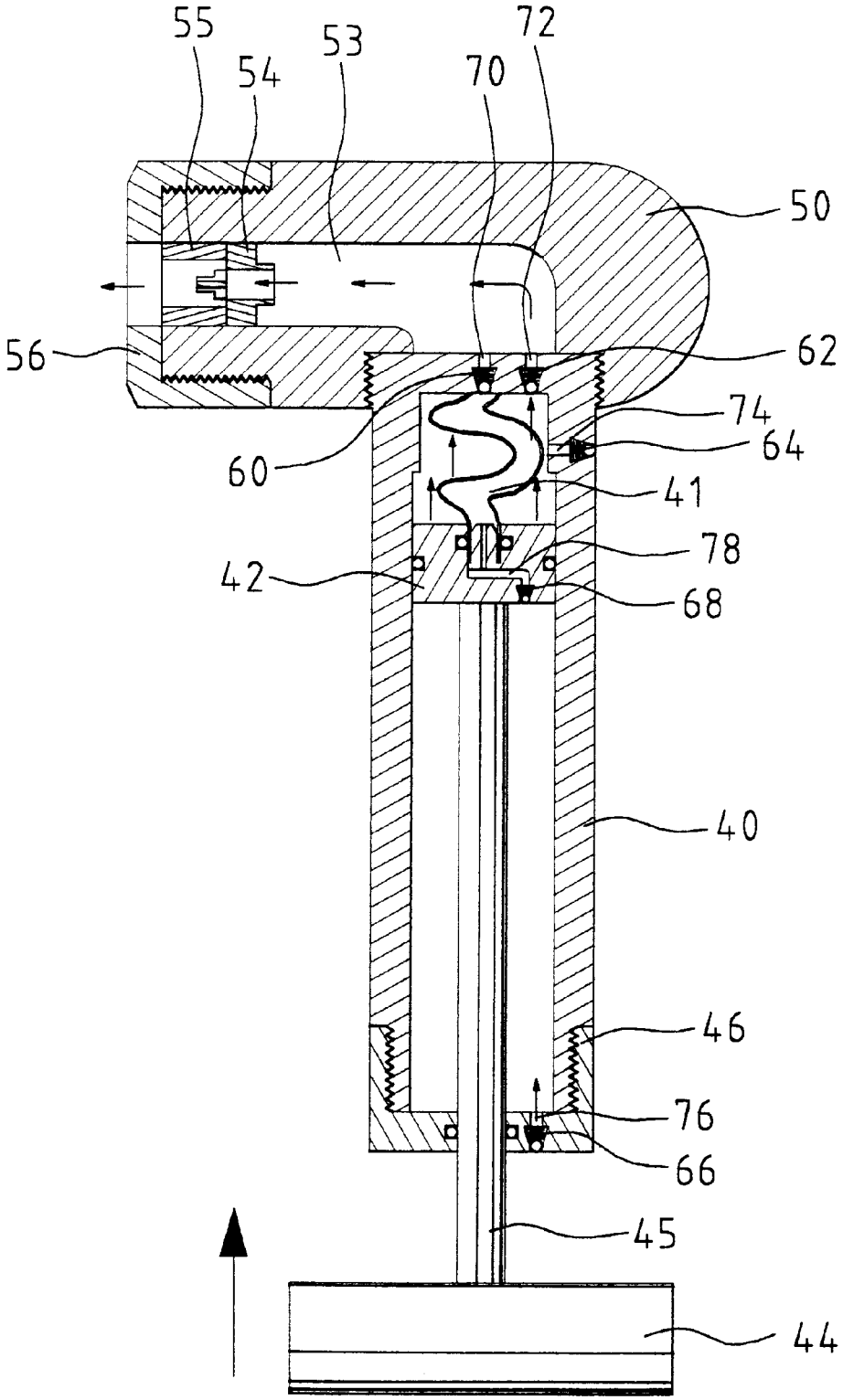
FIG. 15 is a sectional view of the second embodiment of the two-stroke operable pump in accordance with the present invention, illustrating an inward stroke of the piston.

FIG. 15 illustrates an inward stroke of the piston 42 in which the handle 44 is moved toward the main body 40. Air in the upper chamber is outputted via the second hole 72, the main passage 53 and the nozzle 54 to a valve or the like. In addition, ambient air enters the lower chamber via the fourth hole 76 to compensate air and to allow smooth sliding motion of the piston 42 in the main body 40. Thus, air is outputted in both strokes. This allows an efficient pumping effect without effort.

Although the invention has been explained in relation to its preferred embodiment, it is to be understood that many other possible modifications and variations can be made without departing from the spirit and scope of the invention as hereinafter claimed.

What is claimed is:

1. A pump comprising:

a main body defining a chamber therein and including a first end and a second end, a head mounted to the first end of the main body and including a main passage that is adapted to be communicated with a valve, the head further including a side passage, an inner tube securely mounted in the main body and including a first end communicated with the main passage of the head and a second end, a hollow piston slidably received in the main body, the hollow piston separating the chamber of the main body into a first chamber and a second chamber, the first chamber being communicated with atmosphere via the side passage of the head, the hollow piston head further including a first annular groove defined in an outer periphery thereof and adjacent to the first end of the main body, the hollow piston head further including a second annular groove defined in an outer periphery and adjacent to the second end of the main body, the first annular groove including a first notch extended along a longitudinal direction of the hollow piston, the second annular groove including a second notch extended along the longitudinal direction of the hollow piston, a first O-ring being mounted in the first annular groove, a second O-ring being mounted in the second annular groove, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a transverse hole defined therein to communicate an interior of the second section with a space between the first O-ring, the second O-ring, and an inner periphery of the main body, a first valve means mounted in first end of the main body such that air is only flowable from atmosphere to the first chamber of the main body via the side passage, a hollow piston rod having a first end attached to the piston and a second end extended outside the main body, the hollow piston rod including an interior for partially receiving the inner tube and communicated with the interior of the second section of the piston, an end cap mounted to seal the second end of the main body and including a passage that communicates the second chamber of the main body with atmosphere, a second valve means mounted to in second end of the main body such that air is only flowable from atmosphere to the second chamber of the main body via the passage of the end cap, a handle attached to the second end of the piston rod for operation, wherein when during an outward stroke of the piston in which the handle moves away from the main body, the second O-ring is moved to abut an end edge of the second notch to allow communication between the space and the second chamber while the first chamber is not communicated with the space, such that air in the second chamber is outputted to the main passage via the space, the interior of the hollow piston rod, and the inner tube, while ambient air enters the first chamber via the side passage of the head, and wherein when during an inward stroke of the piston in which the handle moves toward the main body, the first O-ring is moved to abut an end edge of the first notch to allow communication between the space and the first chamber while the second chamber is not communicated with the space, such that air in the first chamber is outputted to the main passage via the space, the interior of the hollow piston rod, and the inner tube, while ambient air enters the second chamber via the passage of the end cap.

2. The pump as claimed in claim 1, wherein the side passage of the head is annular, and the first valve means is an annular flexible diaphragm mounted in the first end of the main body.

3. The pump as claimed in claim 1, wherein the passage of the end cap is annular, and the second valve means is an annular flexible diaphragm mounted in the second end of the main body.

4. A pump comprising:

a main body defining a chamber therein and including a first end and a second end, a head mounted to the first end of the main body and including a main passage that is adapted to be communicated with a valve, the head further including a side passage and a first passage, an inner tube securely mounted in the main body and including a first end communicated with the main passage of the head and a second end, a hollow piston slidably received in the main body, the hollow piston separating the chamber of the main body into a first chamber and a second chamber, the first chamber being communicated with atmosphere via the side passage of the head, the first chamber being communicated with the main passage of the head via first passage of the head, the hollow piston head further including a first annular groove defined in an outer periphery thereof and adjacent to the first end of the main body, the hollow piston head further including a second annular groove defined in an outer periphery and adjacent to the second end of the main body, the second annular groove including a notch extended along a longitudinal direction of the hollow piston, a first O-ring being mounted in the first annular groove, a second O-ring being mounted in the second annular groove, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a transverse hole defined therein to communicate an interior of the second section with a space between the first O-ring, the second O-ring, and an inner periphery of the main body, a first valve means mounted to the first end of the main body such that air is only flowable from atmosphere to the first chamber of the main body via the side passage, a hollow piston rod having a first end attached to the piston and a second end extended outside the main body, the hollow piston rod including an interior for partially receiving the inner tube and communicated with the interior of the second section of the piston, an end cap mounted to seal the second end of the main body and including a second passage that communicates the second chamber of the main body with atmosphere, a second valve means mounted to the second end of the main body such that air is only flowable from atmosphere to the second chamber of the main body, a handle attached to the second end of the piston rod for operation, wherein when during an outward stroke of the piston in which the handle moves away from the main body, the second O-ring is moved to abut an end edge of the notch to allow communication between the space and the second chamber while the first chamber is not communicated with the space, such that air in the second chamber is outputted to the main passage via the space, the interior of the hollow piston rod, and the inner tube, while ambient air enters the first chamber via the side passage of the head, and wherein when during an inward stroke of the piston in which the handle moves toward the main body, the second O-ring is moved to disengage from of the notch such that both of the first chamber and the second chamber are not communicated with the space and that air in the first chamber is outputted to the main passage via the first passage of the head, while ambient air enters the second chamber via the second passage of the end cap.

5. The pump as claimed in claim 4, wherein the side passage of the head is annular, and the first valve means is an annular flexible diaphragm mounted in the first end of the main body.

6. The pump as claimed in claim 4, wherein the passage of the end cap is annular, and the second valve means is an annular flexible diaphragm mounted in the second end of the main body.

7. A pump comprising:

a main body defining a chamber therein and including a first end and a second end, the first end including a first hole and a second hole, the main body further including a third hole defined in an outer periphery thereof and adjacent to the first end of the main body, a head mounted to the first end of the main body and including a main passage that is adapted to be communicated with a valve, a piston slidably received in the main body, the piston separating the chamber of the main body into a first chamber and a second chamber, the first chamber being communicated with atmosphere via the third hole of the main body, the main passage of the head being communicated with the upper chamber via the second hole, a hose mounted in the main body and including a first end connected to the first end of the main body and a second end connected to the piston, a first check valve mounted in the first hole of the head such that air is only flowable from the hose to the main passage, a second check valve mounted in the second hole of the head such that air is only flowable from the first chamber to the main passage, a third check valve mounted in the third hole of the main body such that air is only flowable from atmosphere to the first chamber, a piston rod having a first end attached to the piston and a second end extended outside the main body, an end cap mounted to seal the second end of the main body and including a fourth hole that communicates the second chamber of the main body with atmosphere, a fourth check valve mounted in the fourth hole of the end cap such that air is only flowable from atmosphere to the second chamber, the piston further including a fifth hole defined therein for communicating the second chamber with the second end of the hose, a fifth check valve mounted in the fifth hole of the piston such that air is only flowable from the second chamber to the hose, a handle attached to the second end of the piston rod for operation, wherein when during an outward stroke of the piston in which the handle moves away from the main body, air in the second chamber is outputted to the main passage via the fifth hole, the hose, and the first hole, while ambient air enters the first chamber via the third hole, and wherein when during an inward stroke of the piston in which the handle moves toward the main body, air in the first chamber is outputted to the main passage via the second hole, while ambient air enters the second chamber via the fourth hole.

* * * * *